US012479643B2

(12) United States Patent
Bosetti et al.

(10) Patent No.: US 12,479,643 B2
(45) Date of Patent: Nov. 25, 2025

(54) DEGASSING VALVE FOR AN AIRTIGHT CONTAINER AND METHOD FOR MAKING SUCH A VALVE

(71) Applicant: Goglio S.p.A., Milan (IT)

(72) Inventors: Osvaldo Bosetti, Milan (IT); Carlo Muccio, Milan (IT)

(73) Assignee: Goglio S.p.A., Milan (IT)

( * ) Notice: Subject to any disclaimer, the term of this patent is extended or adjusted under 35 U.S.C. 154(b) by 0 days.

(21) Appl. No.: 18/837,662

(22) PCT Filed: Mar. 3, 2023

(86) PCT No.: PCT/IB2023/051999
§ 371 (c)(1),
(2) Date: Aug. 12, 2024

(87) PCT Pub. No.: WO2023/170531
PCT Pub. Date: Sep. 14, 2023

(65) Prior Publication Data

US 2025/0145359 A1 May 8, 2025

(30) Foreign Application Priority Data

Mar. 11, 2022 (IT) ..... 102022000004763

(51) Int. Cl.
*B65D 77/22* (2006.01)

(52) U.S. Cl.
CPC ..... *B65D 77/225* (2013.01)

(58) Field of Classification Search
CPC .... B65D 77/225; B65D 51/165; B65D 51/16; B65D 51/1633; B65D 51/1644;
(Continued)

(56) References Cited

U.S. PATENT DOCUMENTS 3,595,467 A 7/1971 Goglio
4,444,219 A 4/1984 Hollenstein
(Continued)

FOREIGN PATENT DOCUMENTS

DE 102009000805 8/2010
EP 0659657 6/1995
(Continued)

OTHER PUBLICATIONS

Search report and written opinion dated Jun. 20, 2023; Application No. PCT/IB2023/051999; 15 pages.

*Primary Examiner* — Steven A. Reynolds
(74) *Attorney, Agent, or Firm* — Erik J. Overberger; RANKIN, HILL & CLARK LLP

(57) ABSTRACT

The present disclosure concerns a method for making a degassing valve for an airtight container. The valve comprises a main body having a central axis and having at least one opening for the passage of a gas and a seat at least partly superimposed on the opening; a covering element inserted in the seat of the main body to open and/or close the opening, a viscous layer arranged between the main body and the covering element and surrounding the opening. A feature of the valve is that of comprising a plurality of retaining elements realized integral with the main body and surrounding the covering element and at least partly superimposed on the covering element to retain it in proximity to the main body.

3 Claims, 2 Drawing Sheets

(58) Field of Classification Search
CPC .. B65D 79/0087; B65D 81/20; B65B 31/047; B65B 31/04
USPC ..... 220/89.1, 745, 203.16, 203.11, 203.1; 206/524.8; 137/246
See application file for complete search history.

(56) References Cited

U.S. PATENT DOCUMENTS 5,515,994 A * 5/1996 Goglio ..... B65D 51/1644 220/372
5,992,442 A 11/1999 Urquhart et al.
6,056,439 A * 5/2000 Graham ..... B65D 77/225 383/103
6,070,728 A * 6/2000 Overby ..... B65D 81/2023 137/526
7,328,730 B2 * 2/2008 Vilalta ..... B65D 51/1683 220/203.11
8,579,142 B2 * 11/2013 Vanhove ..... B65D 51/1661 220/240
8,727,151 B2 * 5/2014 Valles ..... B65D 41/18 220/366.1
9,010,363 B2 * 4/2015 Huber ..... E03F 5/042 137/527
10,301,088 B1 * 5/2019 Laible ..... B01F 23/00
10,543,963 B2 * 1/2020 Valles ..... B65D 41/205
2002/0066370 A1 * 6/2002 Goglio ..... B65D 77/225 55/385.4
2010/0187230 A1 * 7/2010 Beer ..... B65D 77/225 29/428
2012/0048853 A1 * 3/2012 Stadel ..... B65D 77/225 220/89.1
2012/0103983 A1 * 5/2012 Weaver ..... B65D 77/225 220/89.1
2018/0290797 A1 * 10/2018 Lee ..... B65D 51/1633
2019/0023454 A1 1/2019 Chen
2020/0180854 A1 * 6/2020 Christiansen ..... B65D 51/1677

FOREIGN PATENT DOCUMENTS

EP 1213228 6/2002
EP 2528842 12/2012
FR 2593264 7/1987
WO WO 2011091924 8/2011
WO 2016102096 6/2016
WO 2017018878 2/2017

* cited by examiner

DEGASSING VALVE FOR AN AIRTIGHT CONTAINER AND METHOD FOR MAKING SUCH A VALVE

TECHNICAL FIELD

The present disclosure relates generally to valves for containers, and more particularly to a one-way degassing valve for an airtight cntainer and to a method for manufacturing such a valve.

In particular, the degassing valve is of a one-way type and the airtight container is suitable for containing products that release gas during their storage, that is, products that tend to degas during storage. Such products may for example be aromatic or odorous products, pulverulent products, such as coffee, detergents, fertilizers but also liquid products, fresh pasta or the like.

PRIOR ART

Degassing valves of the type previously identified for containers intended to contain the aforesaid products are known in the state of the art, for example in U.S. Pat. No. 3,595,467, EP 0659657 and EP 1213228.

It is also known the content of patent publication WO 2011/091924, on behalf of the same Applicant, granted in Europe as EP 2528842.

In detail, WO'924 publication discloses a degassing valve for a container suitable for containing products that develop gas. Said container comprises a valve body and a closing element of one-way type, which is movable between a closing configuration in which it blocks the flow of gas and an opening configuration in which instead the passage of gas is allowed.

In particular, both the valve body and the closing element are at least partially realized with a biodegradable material.

The valve-based product described in WO'924 has been a significant commercial success, also due to the reduced environmental impact.

The Applicant, starting from these bases, felt the need to further improve this aspect.

Problem of the Prior Art

In fact, increasingly stringent regulations and customer requests require the creation of degassing valves that are increasingly eco-sustainable, use the least amount of resources and are equally effective compared to the degassing valves known in the state of the art.

However, the design of such a degassing valve introduces a number of technical and manufacturing complexities that are not of simple solution.

Object of the Disclosure

In this context, the technical task underlying the present disclosure is to propose a degassing valve for an airtight container that overcomes the drawbacks of the above-mentioned prior art.

In particular, it is an object of the present disclosure to provide a degassing valve for an airtight container having a significantly reduced environmental impact.

The stated technical task and the specified objects are substantially achieved by a degassing valve for an airtight container comprising the technical features set forth in one or more of the appended claims.

In particular, a first embodiment of the present disclosure relates to a degassing valve for an airtight container. The valve comprises a main body with a central axis and at least one opening for the passage of a gas. The main body also has a seat at least partly superimposed on the opening.

A covering element is inserted in the seat of the main body to open and/or close the opening.

A viscous layer is arranged between the main body and the covering element, so as to surround the opening.

The valve further comprises a plurality of retaining elements made from a single piece with the main body. The retaining elements surround the covering element, and are at least partly superimposed on the covering element to retain it in proximity to the main body.

A second embodiment of the present disclosure relates to a method for realizing a valve according to the first embodiment. The method comprises the step of providing a main body with a central axis and at least one opening for the passage of a gas.

The method further comprises the step of applying a viscous layer on the main body around the opening.

A covering element is applied on the viscous layer.

The covering element is locked on the main body to allow the opening and closing of the opening.

The main body comprises a plurality of protrusions. The step of applying the covering element comprises a sub-step of arranging the covering element between the protrusions. The step of locking the covering element comprises a sub-step of localized plastic deformation of the protrusions to close them on the covering element such that each protrusion defines a respective retaining element of the valve.

Advantages of the Disclosure

The present disclosure solves the technical problem, in that the degassing valve employs a lower amount of material than the known valves since the so-called cap is not present. This allows to obtain a material saving in the production step equal to about 30% compared to the traditional valves and a relative saving in the purchase of material. For example, assuming an annual production of one billion valves, a saving of a few hundred tons of plastic material can be expected.

In addition, the use of a smaller amount of plastic material ensures that the disposal step is less impactful than the valves of the prior art.

Furthermore, in accordance with one aspect of the present disclosure, it is possible to select materials with which to realize the valve with which a valve that meets the regulations in force is obtainable so as to be recognized as recyclable or compostable/biodegradable.

Therefore, thanks to the present disclosure, in addition to having a valve that uses a lower amount of material than the known valves, one also has a valve that meets the current regulations and/or guidelines so as to be recognized as recyclable or compostable/biodegradable whereby the advantage of being able to recycle or transform the valve itself into compost is reached, thus having a further lower impact during disposal.

LIST OF FIGURES

Further characteristics and advantages of the present disclosure will become more apparent from the exemplary, and therefore non-limiting, description of a preferred but not exclusive embodiment of a degassing valve for an airtight container, as illustrated in the appended drawings, wherein.

DETAILED DESCRIPTION

Figure 1:
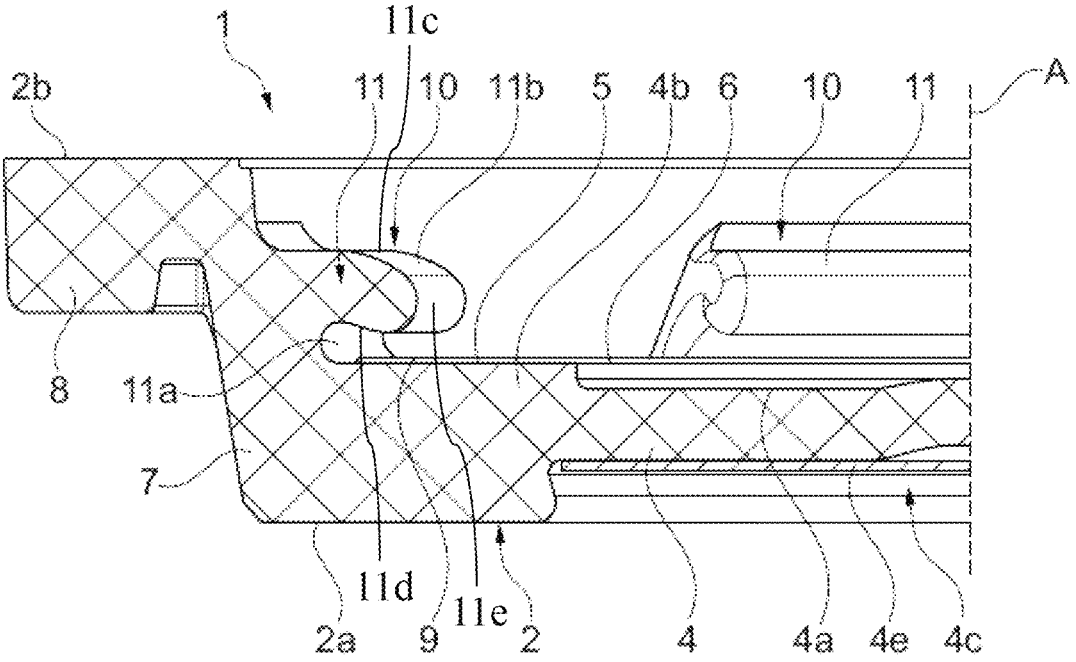
FIG. 1 is a front sectional view of a half of a degassing valve for an airtight container in accordance with an embodiment of the present disclosure.

In the following of the present description the term biodegradable means the series of irreversible chemical reactions through which in nature, or even under artificial conditions, the decomposition of a certain substance takes place. The level of biodegradation to be achieved in order to be included in the certification of biodegradable material is equal to at least 90% to be obtained in no more than 6 months.

The term compostable refers to that spontaneous process that takes place under particular conditions of temperature and humidity (in the so-called composters) at the end of which a waste is transformed into a substance called compost. Waste for it to be declared compostable according to the designation of standard EN 13432 must meet all of the following criteria: a) at least 90% biodegradable in no more than 6 months; b) disintegrable, i.e. fragmentation and loss of visibility in the final compost. The mass of the residues of the test material with a size>2 mm must be less than 10% of the initial mass; c) low levels of heavy metals and absence of adverse effects on compost quality; d) stability of pH values, salt content, volatile solids, N, P, Mg, K.

The term recyclable means those materials that can be used again in production processes. More particularly, recyclable material means that material or mixture of materials that are compatible in both a mechanical and chemical recycling process. Still more particularly, in the context of the present disclosure, the reference guidelines to which the present description applies for the definition of recyclable material to be used in a degassing valve intended for an airtight container are those publicly available, and fully incorporated herein, on the website https://ceflex.eu/.

With reference to the attached figures, a degassing valve for an airtight container in accordance with the present disclosure is indicated with 1.

In detail, the valve 1 comprises a main body 2, which has a central axis "A".

In particular, the main body 2 has an axially symmetrical shape, preferably but not necessarily circular in plan.

The main body 2 is further provided with at least one opening 3 which, in use, allows the passage of gas in a selective manner.

In the illustrated embodiment, the main body 2 comprises four openings 3 (two openings 3 visible in the sections of the attached Figures), in particular each defined by a respective hole 20.

In alternative embodiments, not illustrated, the number and the shape of the openings 3 is variable depending on the operating needs.

In the context of the present description reference will therefore be made to a single opening 3 without however losing generality, since the same technical teachings can also be applied to the solutions with more than one opening 3.

Figure 2:
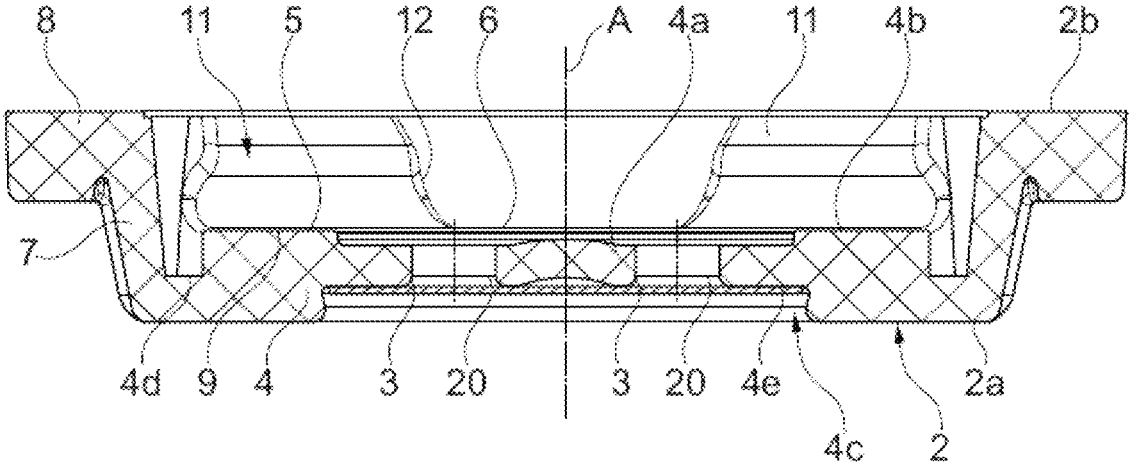
FIG. 2 is a sectional side view of a component of the valve of FIG. 1 in an intermediate step of a method for making the valve of FIG. 1.
Figure 3:
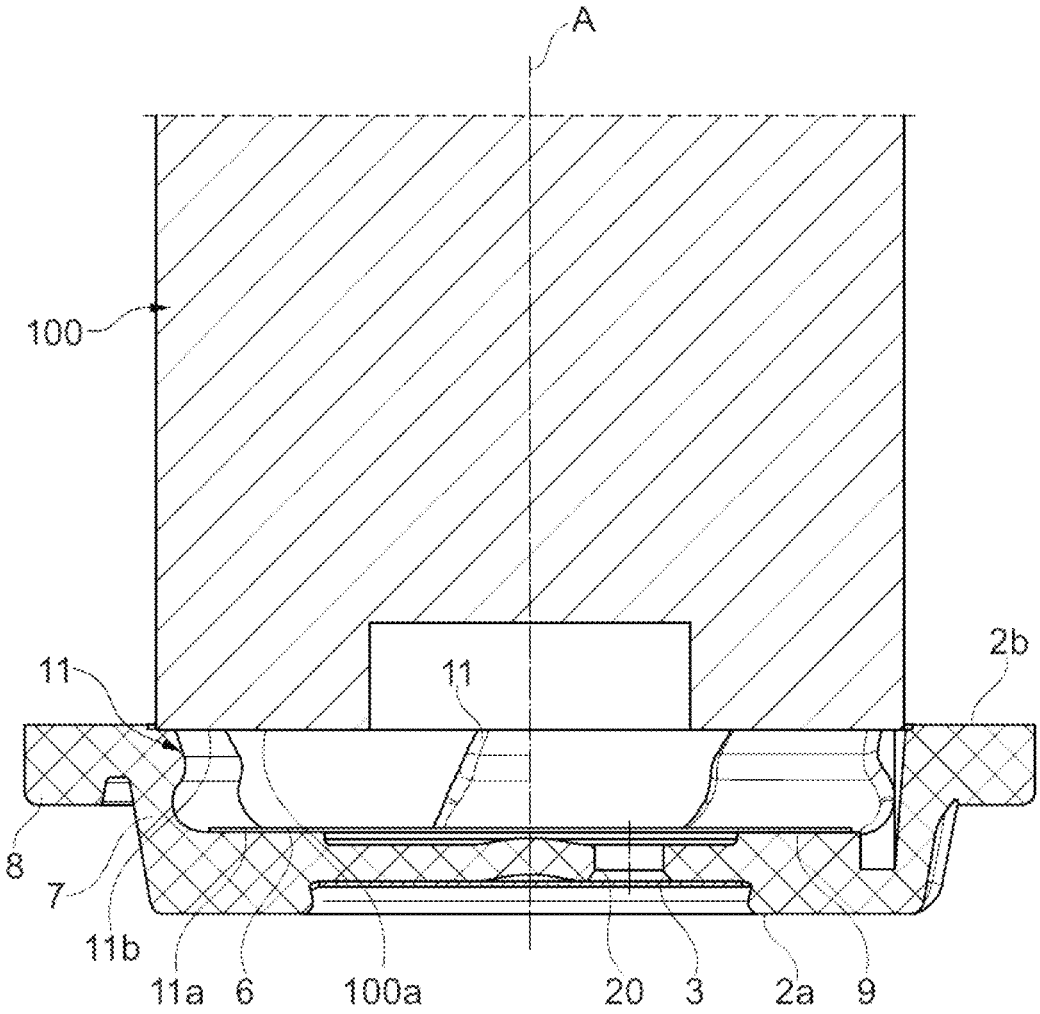
FIG. 3 is the combination of a front view and a side view, both in section, of the component of FIG. 2 during a subsequent step of the method for making the valve of FIG. 1.

With particular reference to FIG. 2, the main body 2 has an inner side 2*a* and an outer side 2*b*.

In use, the inner side 2*a* is placed inside a container (not illustrated) to which the valve 1 is applied.

The outer side 2*b* is opposite to the inner side 2*a*, i.e. in use it is placed outside the container.

In further detail, the main body 2 comprises a base 4, preferably flat, extending substantially perpendicularly to the central axis "A".

On the outer side 2*b*, at the base 4, a central zone 4*a* is identified, on which the openings 3 are obtained.

The central zone 4*a* is surrounded by an intermediate zone 4*b*, in particular raised with respect to the central zone 4*a*.

At the inner side 2*a*, the base 4 has a recess 4*c*.

In use, an internal filter 4*e* is placed inside the recess 4*c* so as to prevent the product placed inside the container from accumulating in the openings 3, obstructing them.

Transversely to the base 4 the main body 2 comprises a side wall 7.

Such side wall 7 is preferably axially symmetrical, even more preferably cylindrical or conical.

The main body 2 further comprises a flange 8 connected to the side wall 7 and opposite to the base 4.

The flange 8 has the function of allowing the valve 1 to be fixed to the container.

As shown for example in FIG. 2, the side wall 7 may have a frusto-conical shape converging from the flange 8 to the base 4.

It should be noted that the main body 2 is provided with a seat 5 at least partly superimposed on the opening 3.

In particular, the seat 5 can be identified on the outer side 2*b* of the main body 2, at the central 4*a* and intermediate 4*b* zones.

A covering element 6 is inserted in the seat 5 and has the function of opening and/or closing the opening 3. In other words, the covering element 6 is a movable element that opens or closes the openings 3 depending on the level of overpressure that is created in the container following the release of the gases generated by the products stored in the container itself. It should be noted that, thanks to the covering element 6, only the escape of the gases is allowed once a certain opening threshold level has been exceeded, but the entry of fluids from the external environment into the container is not allowed, i.e. the valve 1 is realized as a one-way degassing valve.

More in particular, the covering element 6 has a flat, preferably discoidal, shape.

The covering element 6 has an inner surface, facing the opening 3, and an outer surface opposite to the inner surface.

The valve 1 further comprises a viscous layer 9, which is applied between the main body 2 and the covering element 6.

The viscous layer 9 surrounds the opening 3, in particular it is placed on the intermediate zone 4*b* of the base 4.

In use, the viscous layer ensures the adherence of the covering element 6 to the main body 2 and the tight closure of the valve 1.

It should be noted that the covering element 6 is switchable between a closing configuration and an opening configuration.

In the closing configuration, the covering element 6 fully adheres to the viscous layer 9 and tightly closes the opening 3.

In contrast, in the opening configuration the covering element 6 is at least partly separated from the viscous layer 9.

In particular, when the gas inside the container develops a pressure sufficient to overcome the surface tension of the viscous layer 9, the covering element 6 switches from the closing configuration to the opening configuration, allowing the gas to exit.

In accordance with the present disclosure, the valve 1 comprises a plurality of retaining elements 10.

Said retaining elements 10 are realized integral with the main body 2, surround the covering element 6 and are at least partly superimposed thereon so as to retain it in proximity to the main body 2.

It is precisely thanks to the fact that the plurality of retaining elements 10 surround the covering element 6 and are superimposed on the covering element 6 retaining it in proximity to the main body 2 that it is possible to realize the valve 1 without the cap.

In fact, it should be reminded that the cap in a traditional valve, whether it is made of traditional materials or compostable/biodegradable materials, acts as an element capable of retaining the covering element 6 during the movement operations of the valve. In fact, in such a valve of the prior art, in order to prevent the covering element 6 from being able to move from its position and/or even leak, it is provided that the cap acts as a stop for the covering element itself.

In contrast, in the valve in accordance with the present disclosure, the cap is no longer necessary since the retaining elements 10 are confirmed so as to be superimposed on each other at least in part, preferably for the entire extension of the covering element 6 so as to retain it in proximity to the main body 2.

In greater detail, the retaining elements 10 face the outer surface of the covering element 6.

In the opening configuration, the closing element 6, depending on the conditions of use, can be in abutment on at least one of the retaining elements 10 or in any case be even partially detached from the viscous layer 9 to allow the escape of the gases produced by the substances contained in the container but at the same time cannot leak with respect to the main body 2.

More in detail, it should be noted that the retaining elements 10 are each defined by a respective protrusion 11, obtained on the main body 2 and placed externally to the seat 5.

The seat 5 is, in particular, defined by the protrusions 11, i.e. the protrusions 11 keep the closing element 6 in a centred position on the opening 3.

In further detail, the protrusions 11 develop away from the base 4 of the central body 2, in particular on the outer side 2*b*.

It should be noted that each protrusion 11 is curved towards the seat 5.

In other words, the protrusions 11 develop along curved surfaces that tend downwards, i.e. towards the seat 5.

In an embodiment (not shown), the protrusions 11 develop along arcs of circumference around the central axis "A" along an outer zone 4*d* of the base 4, which surrounds the intermediate zone 4*b*.

In particular, each protrusion 11 defines:

an upper surface 11*c* which is curved towards the seat 5;

a lower surface 11*d* which is curved towards the seat 5;

wherein the lower surface 11*d* is joined with the upper surface 11*c* by means of a curved portion 11*e*.

According to a peculiar aspect, the protrusions 11 identify a first head end 11*a* and a second head end 11*b*. The first head end 11*a* turns out to be integral with the base 4 while the second head end 11*b* is free.

In accordance with the embodiment illustrated in the attached figures, each protrusion 11 develops along an arc of circumference around the central axis A and away from the base 4 of the body so the second end 11*b* is such as to be more in proximity to or closer to the central axis A than the first end 11*a*.

Thanks to this conformation of the protrusions 11 it is possible to maintain the closing element 6 in a position centred on the opening 3.

According to one aspect, the valve 1 comprises at least two protrusions 11.

In the embodiment shown in the attached figures, the protrusions 11 are four in number but, in alternative embodiments not illustrated of the present disclosure, the number of the protrusions 11 may be three or any number, such as five, six, seven, eight, etc.

Note that the protrusions 11 are angularly equally spaced with respect to the central axis "A".

In addition, each protrusion 11 is angularly separated from the adjacent protrusions 11 by a respective interval 12.

It should also be noted that each retaining element 10 is made by plastically deforming the respective protrusion 11.

According to one aspect, the degassing valve 1 is made of a recyclable material.

More in detail, the degassing valve 1 is realized at least 90% by means of a single recyclable material, i.e. with at least 90% of a single recyclable material.

In other words, the main body 2, the retaining elements 10 and the covering element 6 of the valve 1 can all be made of the same material for at least 90%. For example, the material may be chosen from PET, polyethylene, polypropylene, and recyclable polymers.

According to one aspect, the degassing valve 1 is made of a recyclable material resulting from a mixture between two or more recyclable materials i.e. with a mixture that is compatible with the recycling step.

In other words, the main body 2, the retaining elements 10 and the covering element 6 of the valve 1 can be made with a mixture of two or more of the materials such as, for example, PET, polyethylene, polypropylene, and recyclable polymers.

Such recyclable materials or mixtures thereof are suitable for recycling by means of a chemical or mechanical recycling.

According to an aspect as an alternative with respect to what was previously described in the selection of the materials with which to realize the valve, the degassing valve 1 is made of a compostable/biodegradable material, i.e. a material selected to meet the specifications classified in standard EN 13432 or the equivalent regulation ISO 14855-1:2005 or the equivalent regulation ASTM D6400-04. As regards in particular standard EN 13432, it is a harmonised standard and reported in the Official Journal of the European Union that provides a presumption of conformity with European Directive 94/62EC on packaging and packaging waste.

According to one aspect, the viscous layer 9 is realized as a biodegradable oil such as a vegetable oil.

A method for making the above-described valve 1 is also part of the present disclosure.

In accordance with this method, the main body 2 and the covering element 6 are realized by known processes, for example moulding.

The viscous layer 9 is applied on the main body 2, in particular in the intermediate zone 4*b*.

Subsequently, the covering element 6 is positioned on the viscous layer 9, in particular between the protrusions 11.

The covering element 6 is then locked onto the main body 2, so as to allow the opening and closing of the opening 3.

In particular, the protrusions 11 are plastically deformed in a localized manner to close them on the covering element 6 so that each protrusion 11 defines a respective retaining element 10.

The localized plastic deformation of the protrusions 11 is made by ultrasound.

In particular, a sonotrode 100 is placed on the protrusions 11, and is then activated to transmit energy to the protrusions 11.

Note that the sonotrode 100 has a contact surface 100*a* in the shape of a circular crown.

Obviously, in order to satisfy contingent and specific needs, a person skilled in the art may make numerous modifications and variants to the configurations described above, all nevertheless contained within the scope of protection, as defined by the following claims.

The invention claimed is:

1. A method for making a one-way degassing valve for an airtight container, comprising:

a main body having a central axis and having at least one opening for the passage of a gas and a seat at least partly superimposed on the at least one opening;

a covering element inserted in the seat of the main body to open and/or close the at least one opening, a viscous layer arranged between the main body and the covering element and surrounding the at least one opening;

said main body comprises a base, extending perpendicularly to the central axis and, transversely to the base, said main body comprises a side wall;

a plurality of retaining elements, made from a single piece with the main body, surrounding the covering element and at least partly superimposed on the covering element to retain it in proximity to the main body;

the retaining elements are each defined by a respective protrusion projecting from the side wall along a radial direction, each protrusion is curved towards said seat;

the method, comprising the steps of:

providing the main body having the central axis and having the at least one opening for the passage of a gas;

applying the viscous layer on the main body around the at least one opening;

applying the covering element on the viscous layer;

locking the covering element on the main body to allow the at least one opening and closing of the at least one opening;

forming integral with the main body the plurality of retaining elements so as to surround the covering element and at least partially superimpose them on the covering element to retain it in proximity to the main body, forming said main body, said covering element and said plurality of retaining elements in a same material or compatible materials in a recycling step;

wherein said step of forming said retaining elements comprises the step of plastically deforming said retaining elements to define the plurality of protrusions that develop away from the base of the central body to close them on the covering element in such a way that each protrusion defines a respective retaining element of the valve.

2. The method according to claim 1, wherein the plastic deformation sub-step is formed by ultrasound.

3. The method according to claim 2, wherein each protrusion comprises the further substeps of:

positioning a sonotrode on one end of each of said protrusions;

activating the sonotrode.

* * * * *